United States Patent [19]

Ross et al.

[11] 4,146,136

[45] Mar. 27, 1979

[54] PIT DETECTOR FOR FOOD PRODUCTS

[75] Inventors: Edward E. Ross, San Rafael; Lynn D. Crawford, San Jose, both of Calif.

[73] Assignee: Del Monte Corporation, San Francisco, Calif.

[21] Appl. No.: 801,513

[22] Filed: May 31, 1977

[51] Int. Cl.[2] ..... B07C 5/34

[52] U.S. Cl. ..... 209/599; 209/604

[58] Field of Search ..... 209/73, 74 R, 74 M, 209/88 R, 88 S, 82, 90, 91; 271/262, 263; 73/78

[56] References Cited

U.S. PATENT DOCUMENTS

| | | | |
|---|---|---|---|
| 2,981,410 | 4/1961 | Perrelli | 209/72 |
| 3,023,899 | 3/1962 | Valentine et al. | 209/88 |
| 3,319,784 | 5/1967 | Granger | 209/74 |
| 3,415,369 | 12/1968 | Hennig | 209/88 |

*Primary Examiner*—Allen N. Knowles

*Attorney, Agent, or Firm*—Gerald L. Moore

[57] ABSTRACT

Apparatus for detecting and separating out articles having pits therein after the product has been passed through a pit removing device. The apparatus includes a pair of detector wheels supported to rotate in the same plane. Each of these wheels is power driven. The adjacent peripheries are spaced apart to receive the articles such that the articles having a greater thickness due to the presence of pits are indicated by the separating force on the wheels.

20 Claims, 10 Drawing Figures

FIG. 6
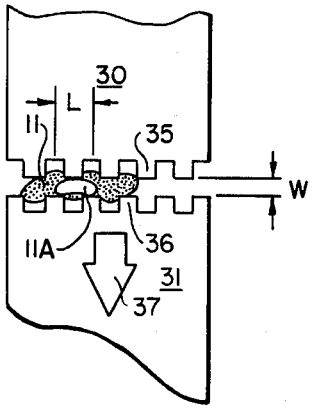
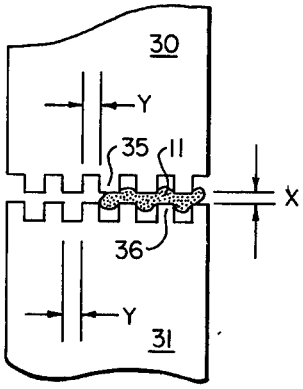
FIG. 5
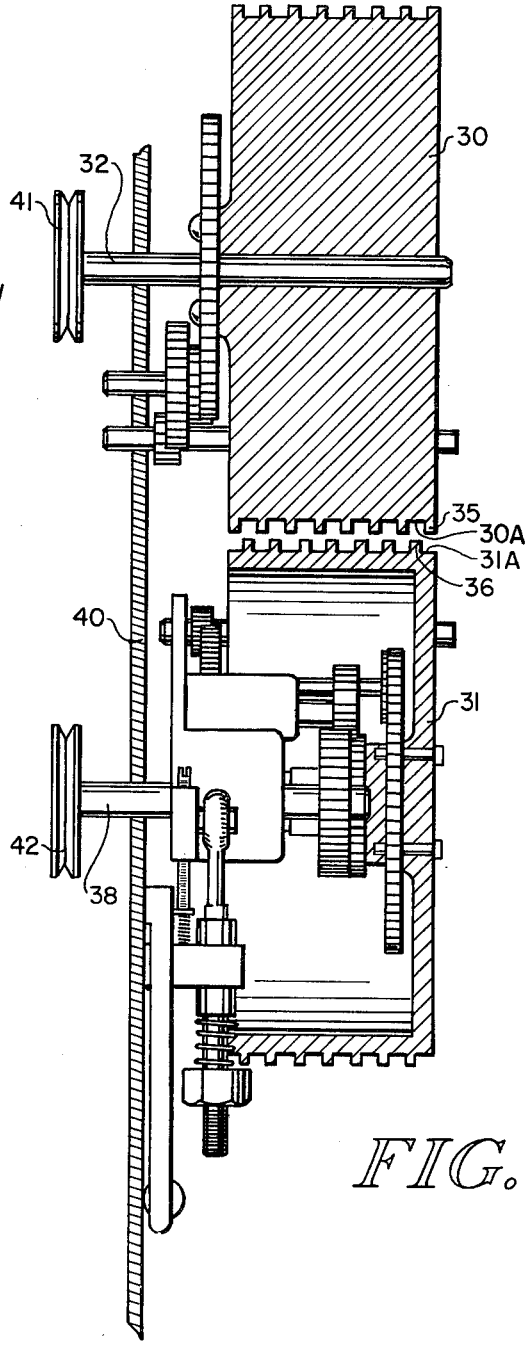
FIG. 4

PIT DETECTOR FOR FOOD PRODUCTS

BACKGROUND OF THE INVENTION

Several products and in particular, prunes, frequently are sold after having the pits removed. Removal of the pits usually has been performed by one of several commercial apparatus available. While such presently-used pit removers are reasonably efficient in removing the pits from such products as prunes, experience shows that there are still some pits which go undetected with the product.

In the past such remaining product with pits usually has been detected to the extent possible by persons handling the product and attempting to pick out those which feel to be larger because of the presence of the pits. Such an approach not only is expensive but also is less than totally effective because it depends upon the skill of the person in detecting the remaining pits. It is the purpose of the present invention to provide a detector which is highly effective in detecting pits to enable their separation from the product stream.

SUMMARY OF THE INVENTION

A pit detector utilizing a pair of wheels rotatably supported on spaced parallel axes for rotation in the same plane with the adjacent portions of the peripheries spaced apart a distance less than the smallest thickness of the pits being detected. The product is fed between the wheels to cause the articles to deform and with the presence of a pit, the wheels are forced apart to accommodate the pit thickness. Such wheel movement indicates the presence of a pit in the article resulting in its being separated from the product stream.

DESCRIPTION OF THE DRAWINGS

FIG. 4 is a cross-sectional view along the line 4—4 of FIG. 3;

FIGS. 5 and 6 are enlarged cross-sectional views of portions of the detector wheels as product without and with a pit are passed therebetween;

DESCRIPTION OF THE INVENTION

Figure 1:
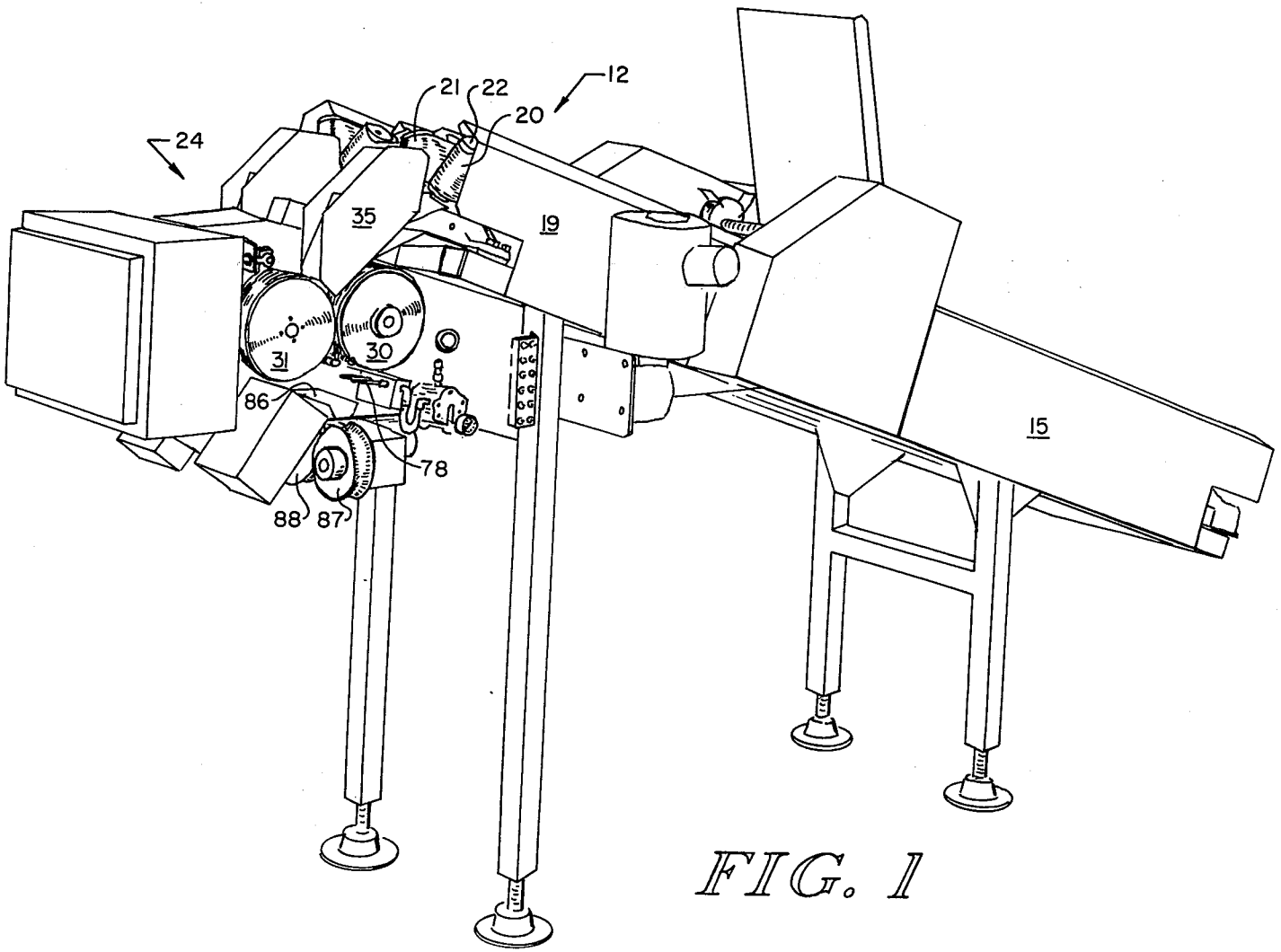
FIG. 1 is a perspective view of the overall pit detector.
Figure 2:
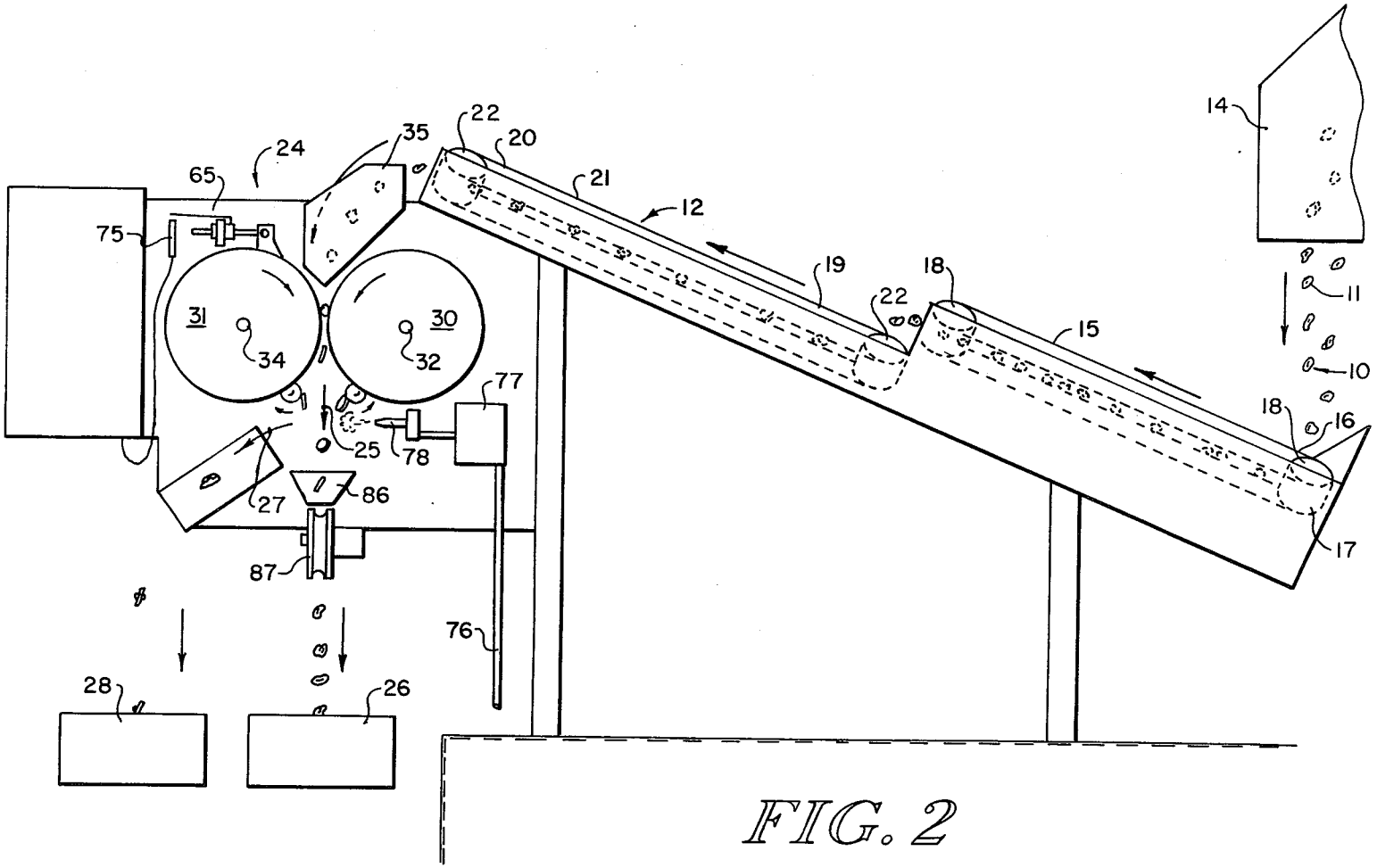
FIG. 2 is a side elevational view of the pit detector and system for separating the product containing pits from the main product stream.

Shown primarily in FIGS. 1 and 2 is the overall apparatus for the detection of articles or product containing pits and removal of those articles from the main product stream 10 in accordance with the present invention. The product is fed to the pit detecting and separating apparatus 12 from a chute 14. Usually the product is received directly from the pit removal apparatus (not shown) and is passed through this pit detection apparatus prior to being further processed. While the apparatus shown in FIG. 1 shows parallel feed lines for the product, only one line will be described since they are identical.

Thus the product drops onto a first V-belt conveyor 15 which is inclined upward in the direction of travel for initiating separation of the articles into single-file order. The conveyor 15 comprises a pair of driven belts 16 and 17 supported individually about pairs of rollers 18. The belts form a V-shaped supporting surface for concentration of the product near the conveyor center. The inclined attitude reduces the piling of the product on top of each other since the articles on top tend to roll backwards until they come to rest on the surface of the belts. The conveyor 15 empties the product onto a faster moving conveyor 19 which also comprises a V-shaped support surface formed of a pair of driven belts 20 and 21 supported about spaced rollers 22. Since the product drops from the end of the slower moving conveyor 15 onto the faster moving conveyor 19, the articles become spaced apart a greater distance along the direction of travel.

The reason for separating the product into single-file and spaced order is to allow individual passage through a pit detector 24 for sensing the remaining pits in the product stream. Ordinarily the product has previously been fed through a machine for removing the pits. The apparatus of the subject invention is used to detect any remaining pits which might be passed on without the pit being removed. Thus the articles are fed in single-file order along the path 25 and if no pit is detected, are permitted to fall into a receptacle or chute 26 for receiving product having no pits. If the pit detector senses a pit, the individual article having the pit is deflected to the path 27 to be deposited into a receptacle 28.

In accordance with the present invention there is provided the pit detector 24 which receives the product such as prunes, passes the articles through individually and detects if a pit or partial pit remains in each article. As shown primarily in FIGS. 2 and 3, the pit detector wheels 30 and 31 mounted for rotation about spaced parallel axes formed by the shafts 32 and 34 respectively. The wheels rotate in the same plane and are normally positioned so that the adjacent peripheries thereof are spaced apart a predetermined distance. The criteria for determining the relative spacing of the wheels will be explained later.

Figure 3:
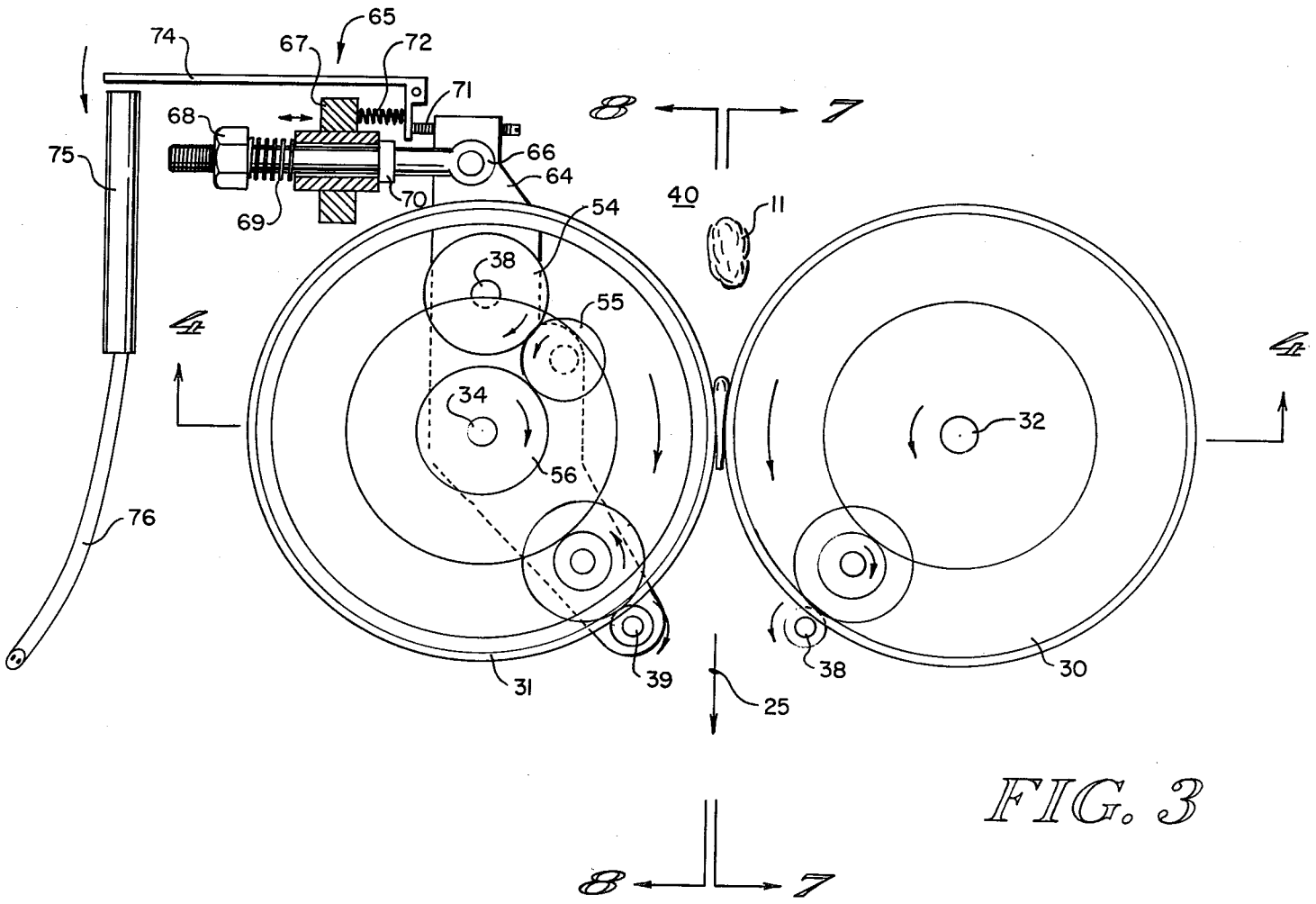
FIG. 3 is an enlarged side view, partially in cross-section, of the pit detecting apparatus.
Figure 7:
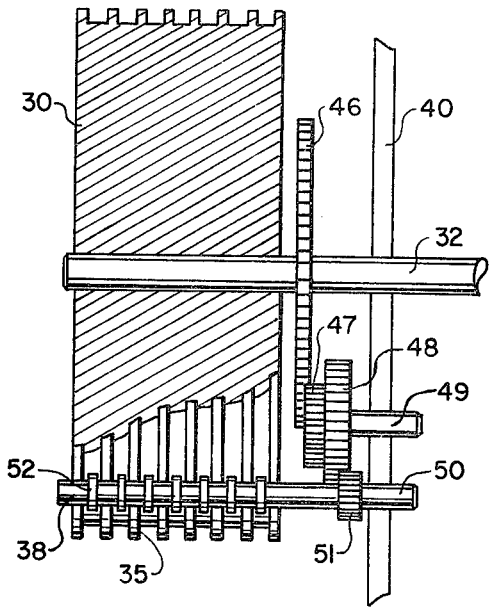
FIG. 7 is a view along the line 7—7 of FIG. 3.
Figure 8:
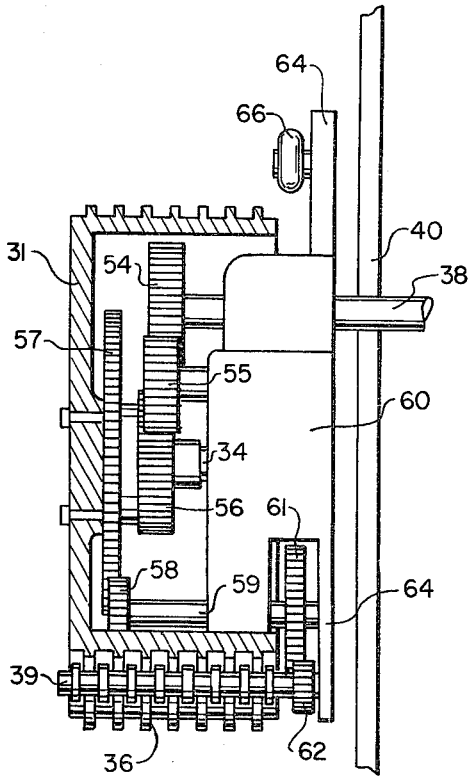
FIG. 8 is a view, partially in cross-section along line 8—8 in FIG. 3.

The wheel 30 is rotated counterclockwise as shown in FIG. 3, while the wheel 31 is rotated clockwise such that each falling article 11 is moving in the same direction as the adjacent wheel peripheries. The wheel 30 has extending about the periphery 30A thereof a plurality of separate parallel spaced ridges 35 (see FIGS. 4–6). Similarly the wheel 31 has on the periphery 31A thereof a plurality of separate parallel spaced ridges 36 also extending in the plane of rotation of the wheel. The ridges on the adjacent wheels are offset from each other so that those on one wheel align with and will fit into the valleys between the ridges on the other wheel as shown.

The present invention is utilized to detect pits in such pliable articles as prunes. In some instances it may be advantageous to pass the articles through a softening bath before passage through the pit detector. Thus as shown in enlarged detail in FIG. 5, as a prune without a pit passes between adjacent wheels, it will conform around the ridges 35 and 36 in the manner shown and exert little or no force tending to move the wheels apart. If one of the products 11 includes a pit 11A as shown in FIG. 6 the pit being a solid body will not yield and therefore will force the wheels apart. The outer edges of the ridges 35 and 36 lie in planes which are a distance X apart. The adjacent ridges on the same wheel also are spaced from each other by a distance Y. Normally as shown in FIG. 6 a prune pit has a minimum length L and has a smaller dimension W indicating the minimum width. Thus the wheels in being positioned to sense prune pits are spaced apart such that the distance X is less than the pit width W which is the minimum width of the pits being detected. Additionally the ridges 35 and 36 are spaced apart on the respective wheels by a distance Y which is less than the distance L or the minimum length of the pits being detected.

Because of the dimensions and the rigidity, the pits will not fit between the ridges 35 and 36 nor bend and deform and will thereby force the wheels apart as they pass therebetween. With one or both of the wheels being supported for movement away from the other, a pit-bearing product passing therebetween will force that wheel away from the other with means being provided for sensing this movement to thereby enable the generation of a signal indicating the presence of a pit. By the careful selection of the spacing of the wheels and the spaces between the ridges 35 and 36 on the same wheel, detection of pit halves which occur occasionally due to the action of the pit removal apparatus is also possible.

It is important not only that any pits be detected, but also that the product pass with little or no permanent damage to the article body. In accordance with an additional feature of the invention, the wheels are rotated such that the peripheral speed thereof approximates the speed at which the product is falling as it reaches the wheels. By equalizing the product speed with the wheel peripheral speed, the relative motion between the product and the wheels on contact is minimized thereby lessening any damage to the article body while assuring that the articles do not pile up at the entry between the wheels.

In accordance with another feature of the invention the passage of a pit between the detector wheels causes movement of the wheel 31 in a direction perpendicular to the path of the product as it passes between the wheels.

Figure 9:
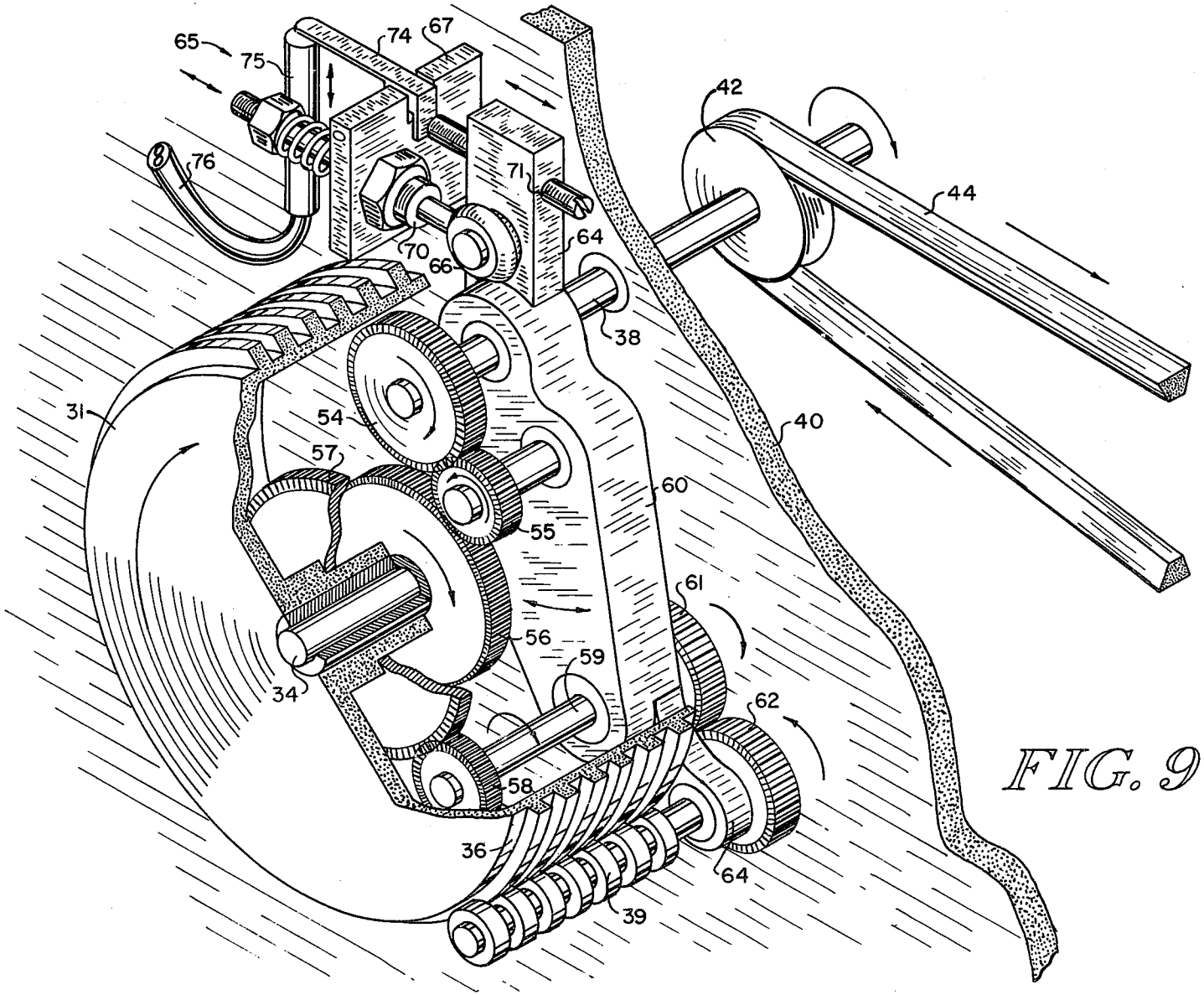
FIG. 9 is a perspective view of one of the detector wheels partially cut away.

In accordance with a further feature of the invention there is provided means to assure that the article separates from each of the wheels 30 and 31 after passage therebetween. Accordingly as shown in FIGS. 3 and 9, there is provided a stripper wheel 38 adjacent the detector wheel 30 and a stripper wheel 39 adjacent the detector wheel 31. These wheels are power-rotated so that the periphery thereof adjacent the associated detector wheel is moving in the direction opposite to that of the adjacent detector wheel to push the articles away from the detector wheel periphery thereby causing them to free fall from the pit detector device.

The embodiment of the present invention incorporating the above-mentioned features is shown primarily in FIGS. 1 through 9. The detector wheel 30 is supported for rotation about the stationary supporting shaft 32 while the detector wheel 31 is supported for rotation about the movable shaft 34. However the wheel 31 is mounted for movement away from the detector wheel 30 about a supporting shaft 38. This supporting shaft serves both to support the wheel 31 and also to transmit driving power to rotate the wheel.

The supporting shafts 32 and 38 extend through a vertically extending plate 40 with the shaft 32 being connected to a pulley 41 (FIG. 4) and the shaft 38 being connected to a pulley 42. These pulleys are power-driven by a belt 44 which extends therearound and to a power unit (not shown) such as a suitable electric motor or can be some other power drive device. For driving the detector wheel 30 the wheel itself is fixed directly to the support shaft 32. Also fixed to this support shaft between the wheel and the mounting plate 40 is a gear 46 (FIG. 7) which meshes with a drive gear 47 fixed to a similar gear 48 mounted on a stub shaft 49 journaled in the mounting plate 40. Also journaled in the mounting plate is a stripping wheel shaft 50 driven by an attached gear 51 meshing with the drive gear 48. The stripper wheel 38 rotates about an axis extending parallel to the outer periphery 30A of the wheel 30 and in a direction perpendicular to the plane of rotation thereof. The stripper wheel also carries a plurality of rings 52 which extend between adjacent ridges 35. Thus the stripper wheel profile is roughly complimentary to the ridges and valleys on the detector wheel so as to separate any articles which might stick on the wheel after passage between the detector wheels. In the manner described, the power-driven shaft 32 serves to drive both the detector wheel 30 and the stripper wheel 38.

The detector wheel 31 is supported in a manner to permit movement relative to the wheel 30 resulting from the presence of a pit in the article passing therethrough. Thus the wheel 31 is supported for rotation about the shaft 34. The shaft 38 is power-driven and has fixed thereto the gear 54 which meshes with an intermediate gear 55. Gear 55 in turn drives the gear 56 which is fixed to the wheel. By driving the wheel in this manner pivotal motion about the shaft 38 is permitted since such motion will only result in the gear 55 riding around the gear 54 while still remaining in driving relationship with the gear 56. Fixed also to the wheel is the gear 57 meshing with a driven gear 58 connected to a shaft 59 which is journaled in the housing 60. The shaft 59 in turn drives the attached gear 61 meshing with the gear 62 fixed to the stripping wheel 39. The stripping wheel also is journaled in the end plate 64 of the housing 60.

The gears 54, 55 and 56 form a three-gear set having characteristics which are well known. With the gears 55 and 56 journaled on shafts rigidly attached to the housing 60, the gear 56 will retain the same relative rotational position as the gear 54 as the housing 60 is rotated about the shaft 38. This is true when the gears 54, 55 and 56 are all the same size. It is also nearly true for gears not the same size and sufficiently so that for a small rotation of the housing 60, the gear 56 retains nearly the same relative rotational position as the gear 54.

Since the wheel 31 is rigidly attached to the gear 56 both of which rotate freely on the shaft 34, then the wheel 31 retains nearly the same relative rotational position as the gear 54. With the gear 54 attached to the shaft 38, the shaft 38 and the shaft 32 being chain-connected and the wheel 30 being rigidly connected to the shaft 32, then wheels 30 and 31 retain the same (opposite) relative rotational position as the housing 60 is rotated.

Thus as the shaft 38 is power driven it in turn rotates the wheel 31 and simultaneously drives the stripping wheel 39. By supporting the stripping wheel 39 and the wheel 31 from the housing 60, rotation of this assembly is permitted about the axis of the driving shaft 38. Because a line through the axis of this shaft 38 and through the axis of the shaft 34 lies parallel to a line tangent to the periphery of the wheel 31 at the point the wheel is the closest to the wheel 30, rotation of the wheel 31 about this driving shaft 38 will move the wheel perpendicularly away from the wheel 30 for the reasons previously described.

Serving as means for sensing movement of the wheel 31 to thereby indicate the presence of a pit in the product passing through the detecting wheels is a switch assembly 65 comprising a shaft 66 pivotally connected to the end plate 64 supporting the wheel 31. This shaft passes through a guide 67 and is held in place by a nut 68 threaded thereon. Positioned between the nut 68 and the guide 67 is a spring 69 which tends to spring bias the wheel 31 towards the wheel 30. A nut 70 positioned on the other side of the guide from the nut 68 serves as a stop for positioning the wheel 31. By adjusting the position of the nut 70, the position of the wheel 31 relative to the wheel 30 can be adjusted.

Thus the shaft 66 and the actuating arm 71 move as the wheel 31 is moved allowing the force of the spring 72 to pivot the actuator 74 into contact with the magnetic reed switch 75. Connecting with the reed switch is a conductor which detects actuation of the switch serving as a signal that the wheel 31 has in fact moved to indicate the presence of a pit in the article passing between the detector wheels. This signal in turn will trigger an air supply 77 (FIG. 1) causing a burst of air to be ejected from the nozzle 78. This burst of air is timed to deflect the article that caused movement of the wheel 31, i.e., containing a pit, from the normal path 25 to the path 27 so that it will fall into the container 28. Thus it can be seen that means are provided for sensing movement of the detector wheel 31 in the form of the actuator 65 causing movement of the actuator 74. With such movement the article passing through the detector wheels will subsequently be deflected from the normal path for separation from the main stream of the product.

Figure 10:
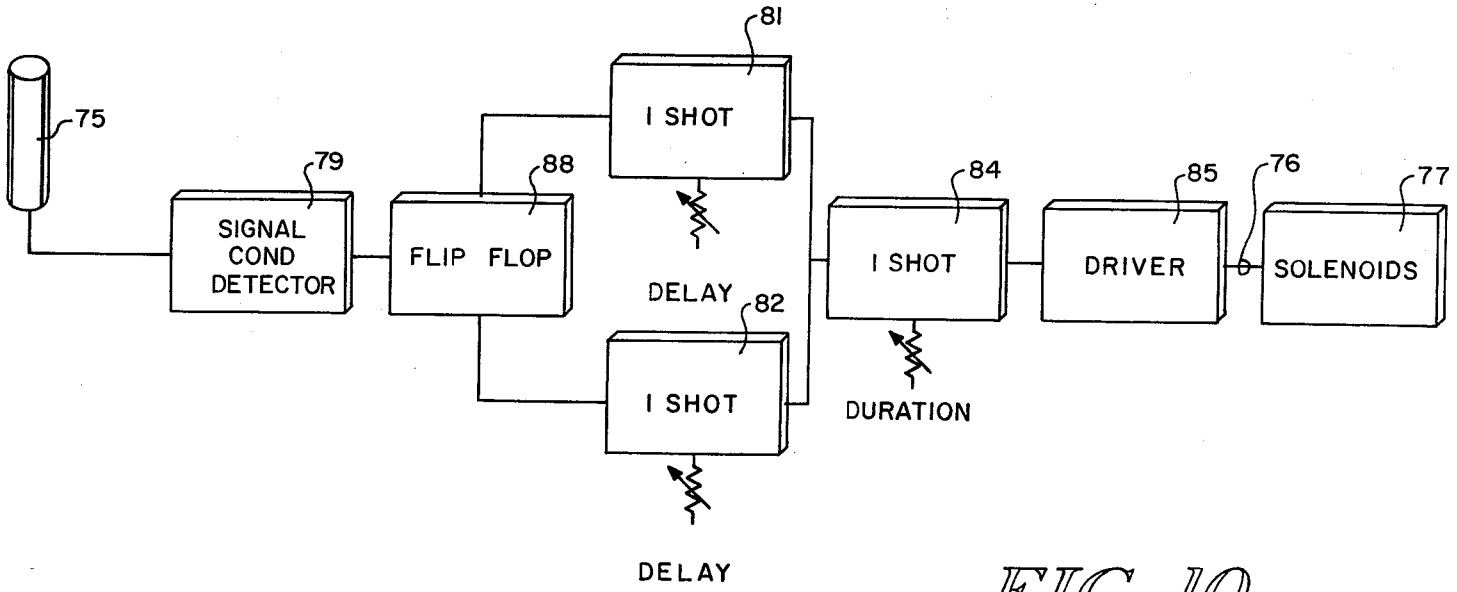
FIG. 10 is a block diagram of the control circuit for the pit detecting apparatus.

Because there is a finite time difference between the passage of a pit bearing article between the detector wheels and the arrival of the same article to a position of alignment with the nozzle 78 for separation from the main product stream, a time delay in the release of the air burst is necessary. Accordingly as shown in FIG. 10, the switch 75 supplies a signal to the signal condition detector 79 which generates a signal responsive to the actuation of the reed switch. This signal is fed to a flip flop 80 which supplies such signals alternately to the delayed one-shots 81 and 82. Thus the one-shot 81 will receive the first signal indicating the presence of a pit and after a predetermined delay, will supply a pulse triggering a one-shot 84 to energize a driver 85 for actuation of the solenoid 77 by supplying a signal through the conductor 76 (FIG. 2).

The next signal received from actuation of the reed switch will be transmitted through the flip flop 80 to the one-shot 82. The alternately acting one-shots 81 and 82 are necessary to provide a circuit with a memory of sufficient length so that if articles having pits follow each other through the detector wheels, the time delay will not prevent the subsequent actuation of the air supply to separate both articles from the product main stream.

In accordance with another feature of the invention the product is reshaped following passage through the detector wheels to approximately its original configuration. For this purpose there is positioned to receive the main stream of the product a funnel 86 serving to guide the product between a pair of rollers 87 and 88. These rollers are power-driven about parallel axes and rotate in the same plane, which plane is positioned perpendicular to the plane of rotation of the detector wheels 30 and 31. As the product passes between the detector wheels it is flattened somewhat and under normal circumstances will not regain its more or less symmetrical configuration. The rollers 87 and 88 have concave peripheral surfaces which serve to force the article back to its normal configuration. Because of the specific positioning of the forming rollers 87 and 88 the article is caused to assume a more-or-less circular cross-section approximating that prior to entry into the pit detecting apparatus.

The invention claimed is:

1. A detector for sensing when articles have a thickness greater than a minimum thickness thereby indicating the presence of pits in an article, comprising in combination:

first and second detector wheels;

means rotatably supporting said detector wheels such that the wheels rotate in the same plane about parallel axes with the peripheries thereof spaced apart a distance less than the minimum thickness of the article and pit being detected;

a drive means for each detector wheel for rotating said detector wheels in opposite directions;

means for feeding said articles between said adjacent detector wheel peripheries in the direction corresponding with the direction the adjacent peripheries are moving; and means for sensing an outward pressure on said detector wheels indicating the presence of a pit in the article.

2. A pit detector as defined in claim 1 wherein the support means of said first detector wheel permits movement of the wheel away from the second detector wheel with the presence of a pit in the article; and said sensing means being operable to sense movement of said first detector wheel to indicate the presence of a pit in the article.

3. A detector for sensing when articles have a thickness greater than a minimum thickness thereby indicating the presence of pits in an article, comprising in combination:

first and second detector wheels; each detector wheel including ridges and valley regions extending about the periphery thereof in the direction of rotation of the wheel;

means rotatably supporting said detector wheels such that the wheels rotate in the same plane about parallel axes with the peripheries thereof spaced apart a distance less than the minimum thickness of the article and pit being detected, said support means of said first detector wheel permitting movement of the wheel away from the second detector wheel with the presence of a pit in the article;

drive means for rotating said detector wheels in opposite directions;

means for feeding said articles between said adjacent detector wheel peripheries in the direction corresponding with the direction the adjacent peripheries are moving; and means for sensing an outward pressure on said detector wheels, said sensing means being operable to sense movement of said first detector wheel to indicate the presence of a pit in the article.

4. A pit detector as defined in claim 3 wherein said ridges on one detector wheel are aligned with the valley regions between the ridges on the other wheel.

5. A pit detector as defined in claim 4 including stripper means positioned adjacent each detector wheel peripheral surface for preventing the articles from adhering to the wheel surface after passage between the adjacent detector wheels.

6. A pit detector as defined in claim 5 wherein said stripper means includes power-driven stripping wheels rotatably mounted adjacent each detector wheel periphery for stripping any article from the wheel which might adhere to the wheel periphery.

7. A pit detector as defined in claim 1 wherein said detector wheels each include raised portions and valley areas and wherein the raised portions in one wheel align with the valley areas on the other wheel.

8. A pit detector as defined in claim 1 including means for reshaping the article back to its original configuration after passage between the detector wheels.

9. A pit detector as defined in claim 8 wherein said means for reshaping includes a pair of shaping wheels mounted for rotation in the same plane, said plane of rotation of the shaping wheels extending perpendicular to the plane of rotation of the detector wheels;

said shaping wheels being supported with the peripheries thereof a distance apart less than the minimum thickness of the articles;

means supporting said shaping wheels in a position to receive the articles after passage between the detector wheels; and drive means for rotating said shaping wheels.

10. A detector for sensing when articles have properties which are greater than a minimum thickness or hardness, comprising in combination:

first and second detector wheels;

first and second supports for said detector wheels;

means rotatably mounting said first and second wheels on said first and second supports respectively so that said wheels rotate about their own axes of rotation, said wheels being positioned to rotate in the same plane of rotation and being normally spaced with their peripheries spaced apart a distance less than the minimum thickness of the articles to be detected;

means rotatably supporting said first support for rotation about an axis of rotation spaced from the axis of rotation of the first wheel, said axis of rotation of the first support being positioned on a line passing through the axis of rotation of the first wheel and extending parallel to a line tangent to the first wheel at the point closest to the periphery of the second wheel;

means biasing said first wheel towards said second wheel;

means for rotatably driving said wheels in opposite directions;

means for feeding articles into the area between the first and second wheels whereby said articles exceeding the minimum thickness will exert an outward pressure on said wheels and said articles less than said minimum thickness will not exert an outward pressure on said wheels; and means for detecting the outward pressure on said wheels for signaling when an article exceeds the minimum thickness and hardness.

11. A detector for sensing the presence of pits in an article wherein the article having a pit has a thickness greater than a minimum thickness and an article without a pit has a thickness less than a minimum predetermined thickness, said detector comprising:

first and second detector wheels;

means rotatably supporting said detector wheels such that they rotate in the same plane and about parallel axes with the peripheries thereof spaced apart a distance less than the minimum thickness;

a drive means and for each detector wheel for rotating said detector wheels in opposite directions;

means for feeding articles along a predetermined path between said adjacent detector wheel peripheries in a direction corresponding with the direction the adjacent peripheries are moving; and means for sensing an outward pressure on said detector wheels caused by the presence of a pit in an article exceeding the predetermined thickness.

12. A detector for sensing the presence of pits in an article as defined in claim 1 wherein said support means for said first detector wheel permits movement of the detector wheel in a direction perpendicular to a line tangent to said detector wheel at the point closest to the second detector wheel.

13. A pit detector as defined in claim 11 including means for deflecting from said predetermined path said articles which exceed the minimum thickness as sensed by the detector wheels.

14. Apparatus for separating articles having a thickness exceeding a predetermined thickness from articles having a thickness less than a predetermined thickness, comprising in combination:

means for feeding the articles in single-file, spaced order along a predetermined path;

a pair of first and second detector wheels;

means for supporting said detector wheels for rotation in the same plane with their peripheries spaced apart a distance less than the predetermined thickness and spaced equal distance to each side of said predetermined path;

separate means for rotating each of said detector wheels in opposite directions so that the peripheries thereof adjacent the predetermined path are moving in the same direction as the articles;

sensing means for detecting a force tending to move the detector wheels apart; and means acting in response to said sensing means detecting a force for deflecting an article from the predetermined path after passage through the detector wheels thereby separating those articles having a minimum thickness greater than the predetermined thickness from the remaining articles.

15. Apparatus as defined in claim 14 wherein said detector wheels are rotated so the peripheries thereof are moving at approximately the speed the articles are moving when they reach the detector wheels.

16. Apparatus for separating articles having a thickness exceeding a predetermined thickness from articles having a thickness less than a predetermined thickness, comprising in combination:

means for feeding the articles in single-file, spaced order along a predetermined path;

a pair of first and second detector wheels, said detector wheels including a plurality of ridges extending about the periphery thereof parallel to the plane of rotation said ridges being spaced apart on each wheel with the ridges on one wheel not aligning with any of the ridges on the other wheel;

means for supporting said detector wheels for rotation in the same plane with their peripheries spaced apart a distance less than the predetermined thickness and spaced equal distance to each side of said predetermined path;

means for rotating said detector wheels in opposite directions so that the peripheries thereof adjacent the predetermined path are moving in the same direction as and at approximately the speed of the articles when they reach the detector wheels;

sensing means for detecting a force tending to move the detector wheels apart; and means acting in response to said sensing means detecting a force for deflecting an article from the predetermined path after passage through the detector wheels thereby separating those articles having a minimum thickness greater than the predetermined thickness from the remaining articles.

17. Apparatus as defined in claim 16 wherein said means for supporting said first wheel pivots about an axis spaced from the axis of rotation of the first wheel, said support axis being positioned on a line passing through the axis of rotation of the first wheel and which extends parallel to the predetermined path for the articles.

18. Apparatus as defined in claim 17 wherein said sensing means includes means for detecting rotation of the support for the first wheel about its axis of rotation.

19. Apparatus as defined in claim 18 including means for reshaping the articles back to their original configuration after passage between the detector wheels.

20. Apparatus as defined in claim 19 wherein said means for reshaping comprises a pair of shaping wheels mounted for rotation in the same plane with the peripheries thereof spaced apart a distance less than the minimum thickness, said plane of rotation of the reshaping wheels being positioned perpendicular to the plane of rotation of the detector wheels.

* * * * *